US007448398B2

(12) United States Patent
Glucksman et al.

(10) Patent No.: US 7,448,398 B2
(45) Date of Patent: Nov. 11, 2008

(54) SONIC JEWELRY CLEANER

(75) Inventors: Dov Z. Glucksman, Danvers, MA (US); Laura J. Nickerson, Andover, MA (US); Gary P. McGonagle, Lynn, MA (US)

(73) Assignee: Connoisseurs Products Corporation, Woburn, MA (US)

( * ) Notice: Subject to any disclaimer, the term of this patent is extended or adjusted under 35 U.S.C. 154(b) by 503 days.

(21) Appl. No.: 10/861,328

(22) Filed: Jun. 4, 2004

(65) Prior Publication Data

US 2005/0268950 A1 Dec. 8, 2005

(51) Int. Cl.
*B08B 3/12* (2006.01)

(52) U.S. Cl. ..... 134/84; 134/148; 134/57 R; 134/117; 134/92; 366/108

(58) Field of Classification Search ..... 134/148, 134/57 R, 84, 117, 92
See application file for complete search history.

(56) References Cited

U.S. PATENT DOCUMENTS

| | | | | |
|---|---|---|---|---|
| 3,151,846 | A | 10/1964 | George | |
| 3,291,458 | A * | 12/1966 | Hamm | 366/110 |
| 3,640,294 | A | 2/1972 | Piccolo | |
| 3,771,772 | A | 11/1973 | Honda | |
| 4,007,982 | A | 2/1977 | Stange | |
| 4,112,955 | A | 9/1978 | Gollel | |
| 4,167,341 | A | 9/1979 | Doyel | |
| 4,336,816 | A * | 6/1982 | Horz et al. | 134/110 |
| D281,539 | S * | 11/1985 | Harrison | D32/1 |
| 4,597,399 | A * | 7/1986 | Rabenau et al. | 134/184 |
| 4,735,223 | A | 4/1988 | Ituarte | |
| 4,779,633 | A | 10/1988 | Thomas et al. | |
| 5,237,778 | A | 8/1993 | Baer | |
| 5,534,741 | A * | 7/1996 | Smith | 310/317 |
| 5,580,394 | A * | 12/1996 | Freytag | 134/10 |
| 6,193,806 | B1 | 2/2001 | Reed | |
| 6,494,222 | B1 | 12/2002 | Mitsumori et al. | |
| D474,565 | S * | 5/2003 | Pinchuk et al. | D32/1 |
| 6,719,850 | B2 | 4/2004 | Glucksman et al. | |
| 6,821,355 | B1 * | 11/2004 | Taylor et al. | 134/32 |
| 7,081,081 | B2 * | 7/2006 | Schutz et al. | 494/12 |

OTHER PUBLICATIONS http://www.homefocuscatalog.com/product.asp?product=218319zz &dept%5Fid=511 Blitz Jewelry Cleaning Machine.

www.awesomegems.com/jewelry.cleaners.html#top Gem and Jewelry Cleaners.

(Continued)

*Primary Examiner*—Frankie L. Stinson
*Assistant Examiner*—Samuel A Waldbaum
(74) *Attorney, Agent, or Firm*—George A. Herbster

(57) ABSTRACT

A sonic cleaner for small articles includes two tanks for receiving a liquid and articles to be cleaned and a base unit having chambers for receiving each tank. A vibratory motion generator attaches to the base unit through an isolating structure. Complementary attachment elements on the vibratory motion generator and each tank form a releasable, rigid connection. When the tank is attached to the vibratory motion generator, liquid in the tank can be agitated. When the releasable, rigid connection is detached, the tank can be removed from the base unit for disposing of liquid in the tank without having to handle the entire sonic cleaner.

25 Claims, 10 Drawing Sheets

OTHER PUBLICATIONS www.ekitchengadgets.com keyword search:sonic jewelry cleaner, http//store.yahoo.com/dotcoms/colasoiilsoj.html Connoisseurs La Sonic III Sonic Jewelry Cleaner.

http://www.boscovs.com/webbapp/wcs/stores/servlet/ProductForm?productId=462570&storeId=10001&langId=1 Powervescent by Lockhart Sonic Jewelry Cleaner.

* cited by examiner

SONIC JEWELRY CLEANER

BACKGROUND OF THE INVENTION

1. Field of the Invention

This invention generally relates to apparatus for cleaning articles with a liquid and more specifically to a cleaning apparatus that agitates the liquid for cleaning such articles.

2. Description of Related Art

Jewelry, especially types that are worn frequently, often becomes soiled in use and requires frequent cleaning in order to maintain its appearance. Many consumers are without means to clean such jewelry adequately at home. A consumer takes the articles to a jeweler for steam cleaning or the like, which is inconvenient and expensive and consequently usually done infrequently.

As a result, a number of home cleaning systems for jewelry are being marketed. Characteristically, these devices include one or two tanks for cleaning and rinsing solutions in which items can be immersed. Usually means are provided to vibrate the tank and dislodge any particles and ensure that the solution can circulate and clean all surfaces. U.S. Pat. No. 6,719,850 to Glucksman et al., and assigned to the same assignee as this invention, provides a small, quiet sonic cleaner. A tank rigidly connects to a vibration generator, such as an eccentrically loaded motor. The vibration generator is flexibly coupled to a base upon which the cleaner sits. The coupling to the tank is preferably through progressive motion attenuators, such as springs that provide vibration isolation for the tank. This sonic cleaner includes a single integral tank.

Jewelry cleaners with two tanks are characterized by using tanks that are formed as an integral part of a base unit. If it is desired to renew or exchange one of the solutions, solutions in both tanks must be handled. This is not a major issue if the cleaning solvent is to be exchanged because water is inexpensive and easily replaced. However, a problem exists when it is merely desired to change the rinse water because the cleaning solvent must also be poured from the tanks. One possible solution is to siphon or otherwise displace the solvent into another container, but this requires additional equipment and is inconvenient to use.

These cleaners typically are constituted by injected molded plastic structures. Any plastic that contacts the solvent must be chemically inert with the solvent. Such plastics are available, but may be more expensive than plastics that would be satisfactory from a structural standpoint in certain applications. However, these structures tend to be injection molded from the same chemically inert plastic even though a significant portion never contacts any liquid.

Therefore a need exists for a sonic cleaner with twin tanks that allows independent disposal and handling of liquids, that reduces manufacturing costs and that can be packaged compactedly.

SUMMARY

Therefore it is an object of this invention to provide a sonic cleaner that facilitates the handling of liquids.

Another object of this invention is to provide a dual-tank sonic cleaner.

Still another object of this invention is to provide a dual-tank sonic cleaner which overcomes the problem of handling liquids that exist in prior art devices.

Yet another object of this invention is to provide a dual-tank sonic cleaner that can be constructed with reduced manufacturing costs.

Yet still another object of this invention is to provide a dual-tank sonic cleaner that can be formed in a compact package.

In accordance with this invention a sonic cleaner for small articles comprises a tank for receiving a liquid and articles to be cleaned. A base unit receives the tank. A vibratory motion generator attaches to the base unit. A first attachment element on the vibratory motion generator and a second attachment element on the tank form a releasable rigid connection. When the two elements are attached, the vibratory motion generator agitates liquid in the tank. When the first and second attachment elements are released, the tank can be removed from the base unit.

In accordance with another aspect of this invention, a sonic cleaner for small articles includes first and second tanks for receiving a liquid and articles to be cleaned. A base unit has first and second means for receiving the first and second tanks. A vibratory motion generator attaches to the base unit and includes first attachment elements. One of the first attachment elements is positioned with respect to the first receiving means and the other attachment element is positioned with respect to the other receiving means. A second attachment element is mounted to each tank. Corresponding ones of the first and second attachment elements form a releasable rigid connection between the vibratory motion generator and the respective tank. When the tank is attached, the vibratory motion generator agitates liquid in the corresponding tank. When detached the corresponding tank can be removed from the base unit.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
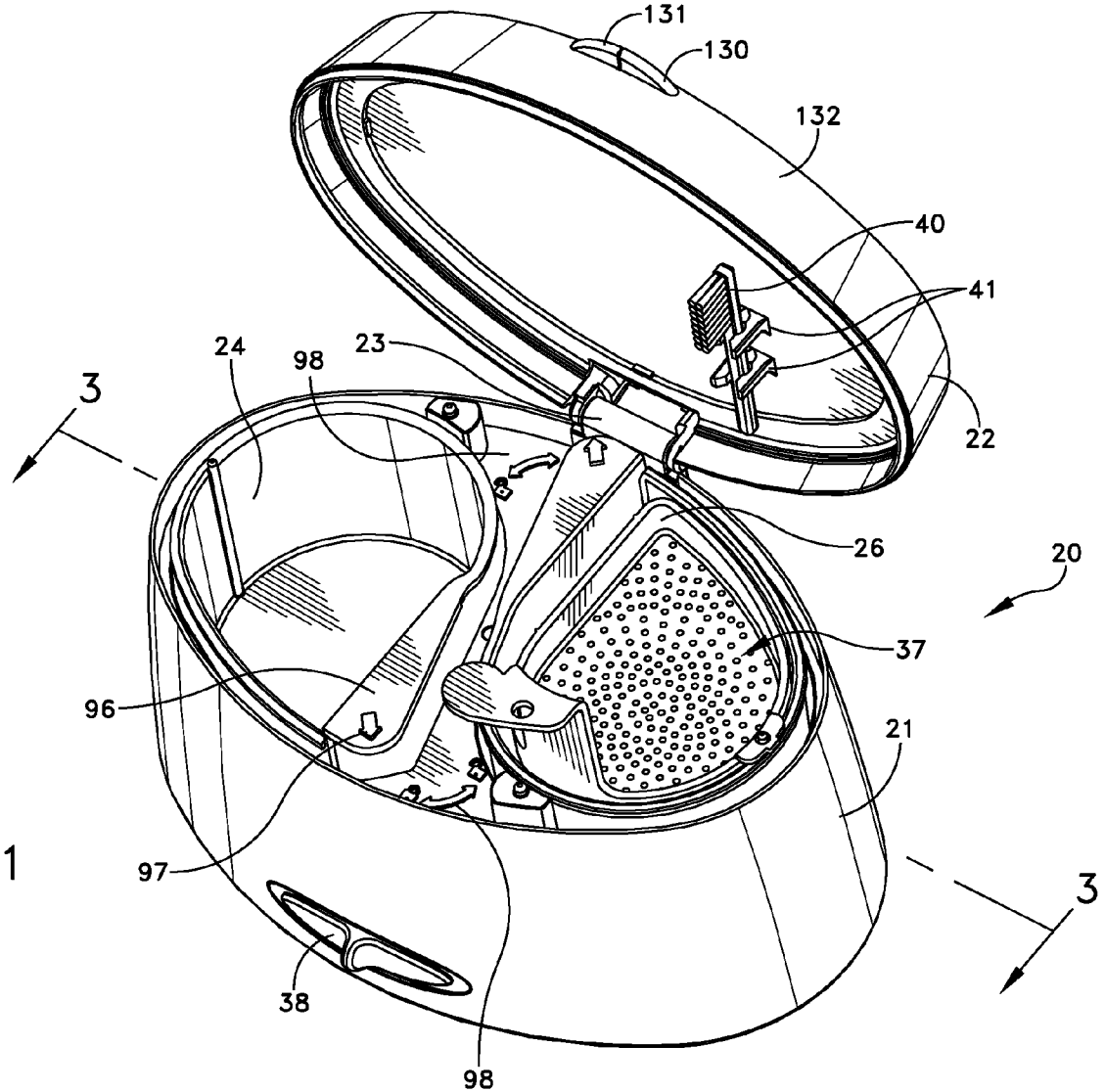
FIG. 1 is a perspective view of a sonic cleaner constructed in accordance with this invention.
Figure 2:
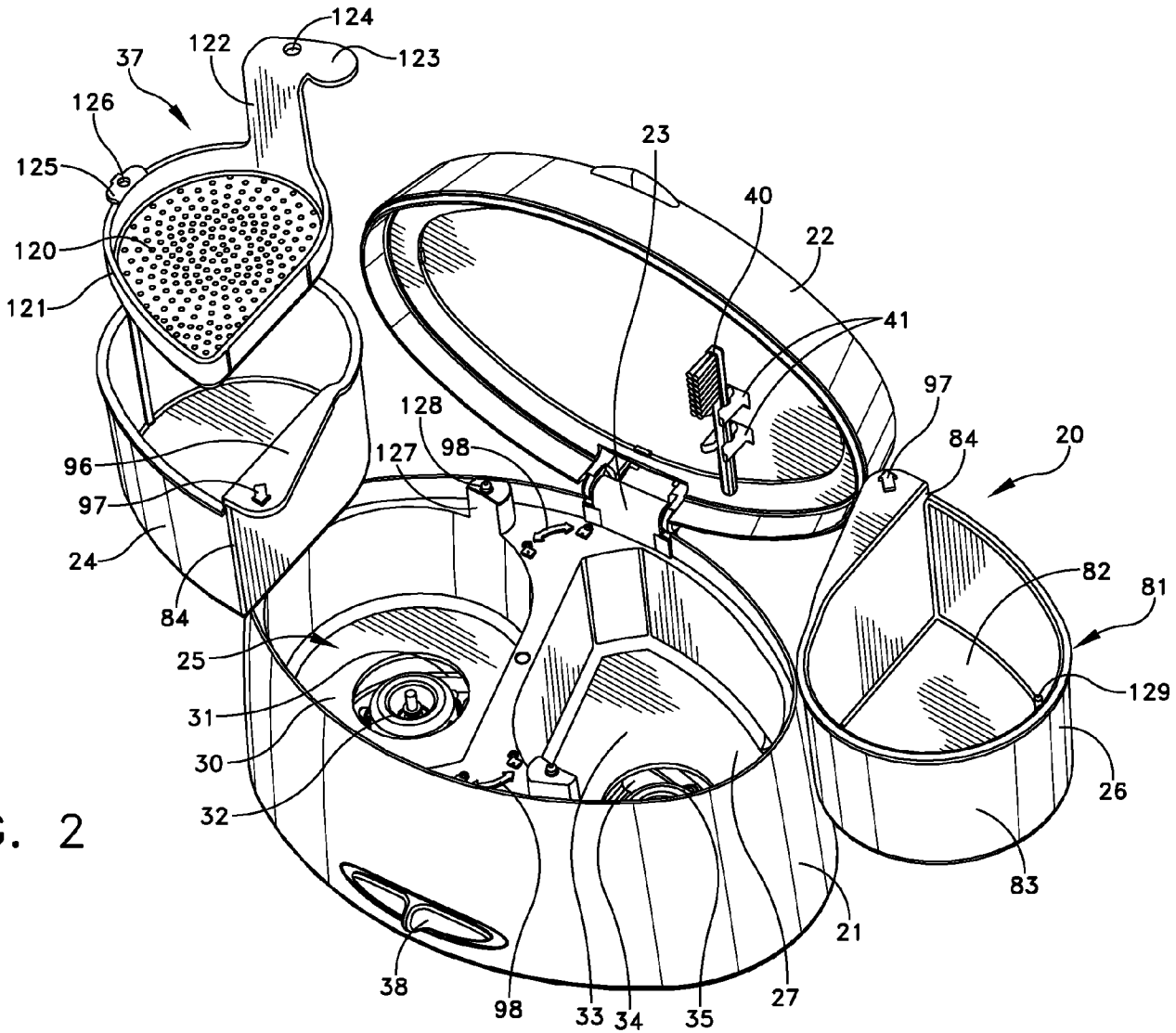
FIG. 2 is a partially exploded view of the sonic cleaner shown in FIG. 1.
Figure 3:
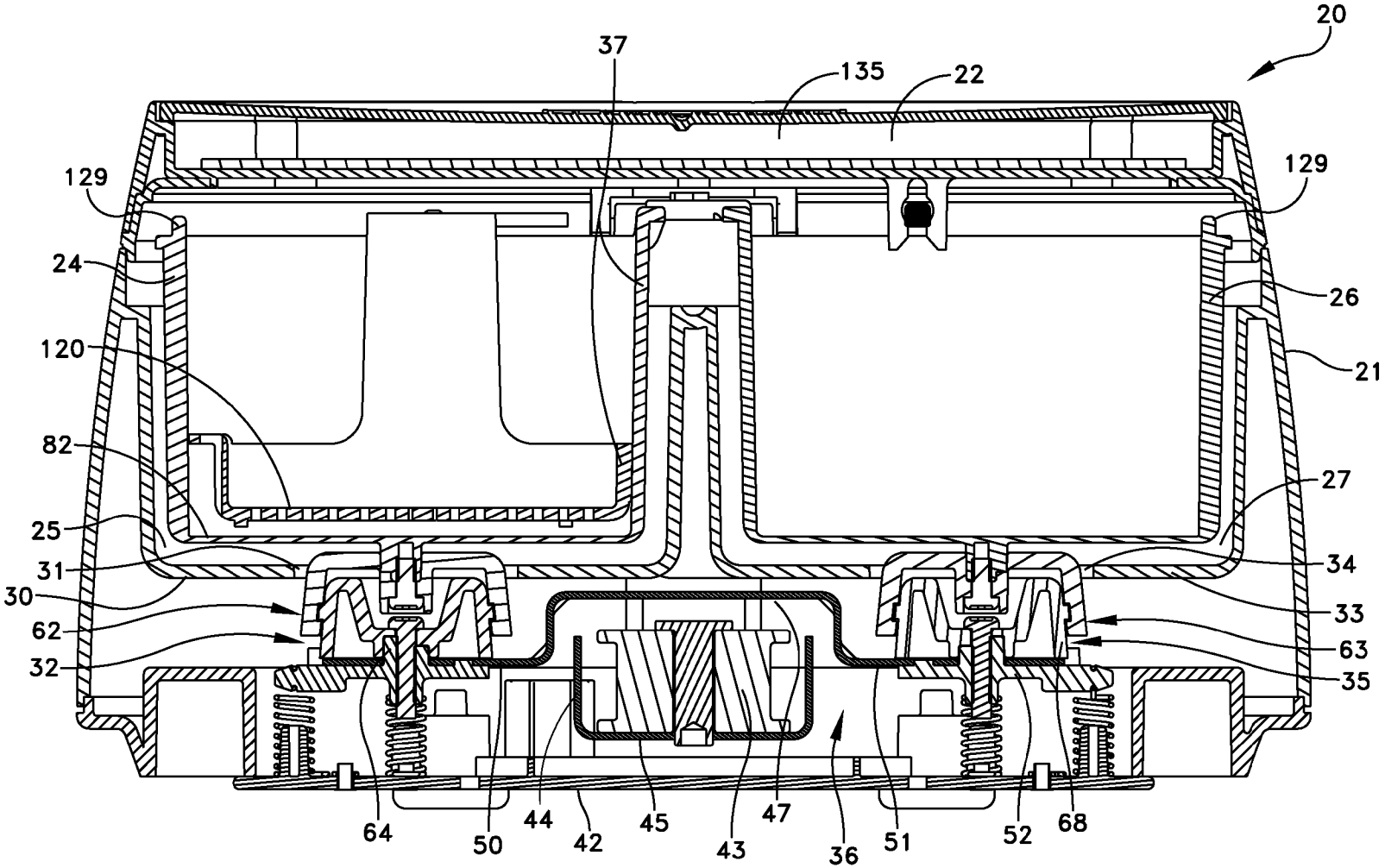
FIG. 3 is a cross-section view of the structure shown in FIG. 1 taken basically along lines 3-3 in FIG. 1.

FIGS. 1, 2 and 3 depict a sonic cleaner 20 for small articles that includes a base unit 21. A lid 22 attaches to the base unit 21 by a hinge 23. FIGS. 1 and 2 depict the cleaner 20 with the lid 22 open. FIG. 3 depicts the lid 22 closed. The base unit 21 receives a left tank 24 in a chamber 25 and a right tank 26 in a chamber 27. The base unit 21, that defines the chambers 25 and 27 is formed by injection molding.

The base unit 21 defines the bottom of the chamber 25 with a floor 30 through which an aperture 31 exposes a first attachment element 32 for the tank 24. A similar structure associated with the chamber 27 includes a floor 33 with an aperture 34 that exposes a first attachment element 35 for the tank 26. The first attachment elements 32 and 35 are part of a vibratory motion generator 36 that oscillates or vibrates the first attachment elements 32 and 35 along vertical axes to agitate any liquid in the tanks 24 and 26, respectively. FIGS. 1 and 2 also depict a basket 37 that fits in either tank and is spaced from the bottom as described more fully hereinafter. In FIG. 1 the basket is positioned in tank 26, in FIG. 2 the basket 37 is positioned over the tank 24 and in FIG. 3 the basket 37 is located in the tank 24.

In operation and in accordance with one aspect of this invention, the tanks 24 and 26 can be removed from the base unit 21. For example, the tank 24 could be removed to be filled with a cleaning solution or solvent while the tank 26 could be removed to be filled with a rinsing solution, such as water. Obviously, such solutions could be poured into the tanks 24 and 26 while they are in the chambers 25 and 27. With the tanks 24 and 26 located in the chambers 25 and 27, respectively and attached to the vibratory motion generator 36, articles can then be placed in the basket 37 which is lowered into a tank, such as the tank 24 as shown in FIGS. 2 and 3. A switch 38 can be moved to activate the vibratory motion generator 36. This initiates agitation of the liquid in the tanks. If upon inspection of the articles after cleaning there is any residual material, a brush 40 carried in the lid 22 by means of integral clips 41 can be used.

When the cleaning cycle is complete, the switch 38 can be returned to an open condition and the basket 37 can be removed from one tank, such as the tank 24 for inspection and placed in the tank 26 with the rinsing solution as shown in FIG. 1.

Figure 4:
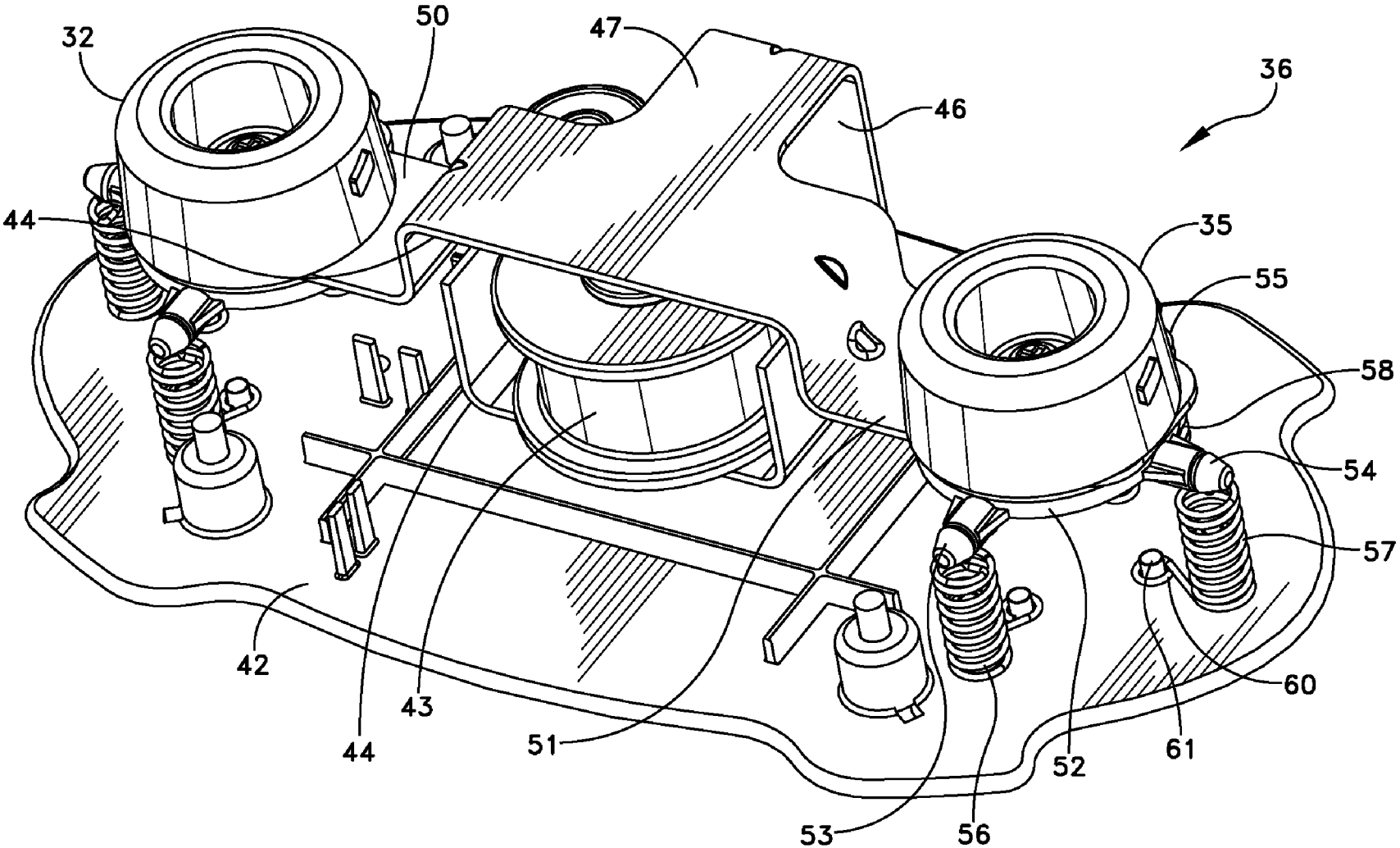
FIGS. 4 and 5 are two perspective views of a vibratory motion generator useful in the operation of this invention.
Figure 5:
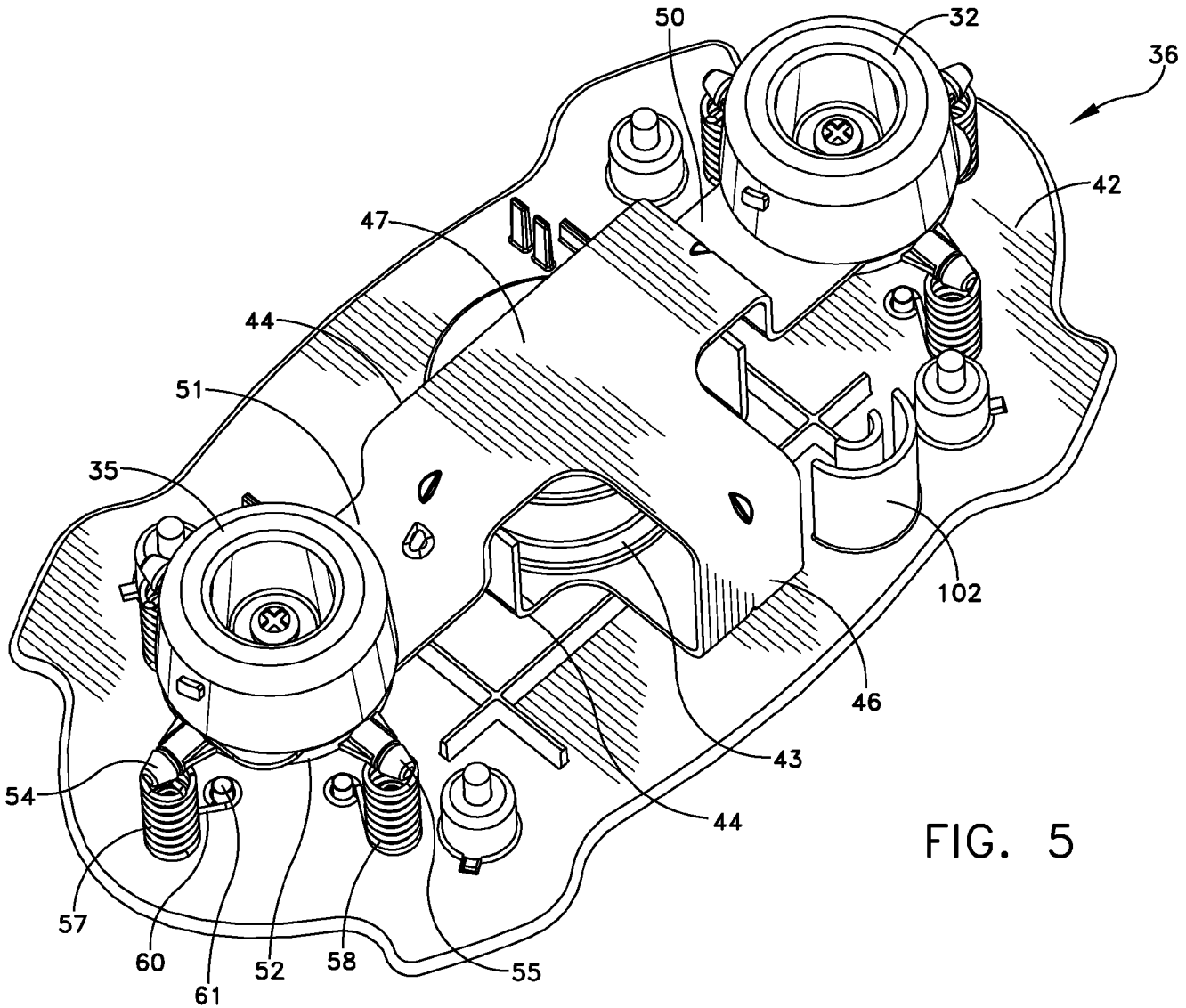

As previously indicated, the vibratory motion generator 36 agitates any liquid in the tanks. Specifically, referring to FIGS. 3 through 5, the vibratory motion generator 36 is spaced above a floor 42 spanning the base unit 21. It includes a u-shaped ferrous member 44 with a lower leg affixed to the bottom of a coil 43 and a vertical section 46 that acts as a connector to an upper leg 47. The upper leg 47 is proximate the coil 43 and includes two laterally extending wings 50 and 51, all of which act as an armature. The wing 50 supports the first attachment element 32; the wing 51 supports the first attachment element 35.

Springs isolate the coil 43 and ferrous metal structure 44 from the floor 42. Specifically, the wing 51 carries a spring support plate 52 with three radial extensions 53, 54 and 55. A first end of each of springs 56, 57 and 58 attaches to a corresponding one of the radial extensions 53, 54 and 55. The other end of each spring attaches to the floor 42. For example, the spring 57 has a tail 60 that attaches to a pin 61 extending from the floor 42. The springs provide vibration isolation for the floor 42 and the base unit 21.

Although other vibration isolators, such as elastomers, may be used in place of the springs, it is preferred that the isolators be progressive motion attenuators. Springs and other progressive motion attenuators, in which the returning force increases with displacement, provides superior definition of movement of the tank, reducing rattle and the possibility of energy being transferred to the base unit 21 if it is struck by the tank.

The springs provide the only support of the tanks 24 and 26 by the base unit 21. As will be apparent to those skilled in the art, this structure permits vibrations generated by the vibratory motion generator 36 to be very efficiently restricted to the tanks 24 and 26. This allows the cleaner 20 to use minimal power and provides quieter operation.

Figure 6:
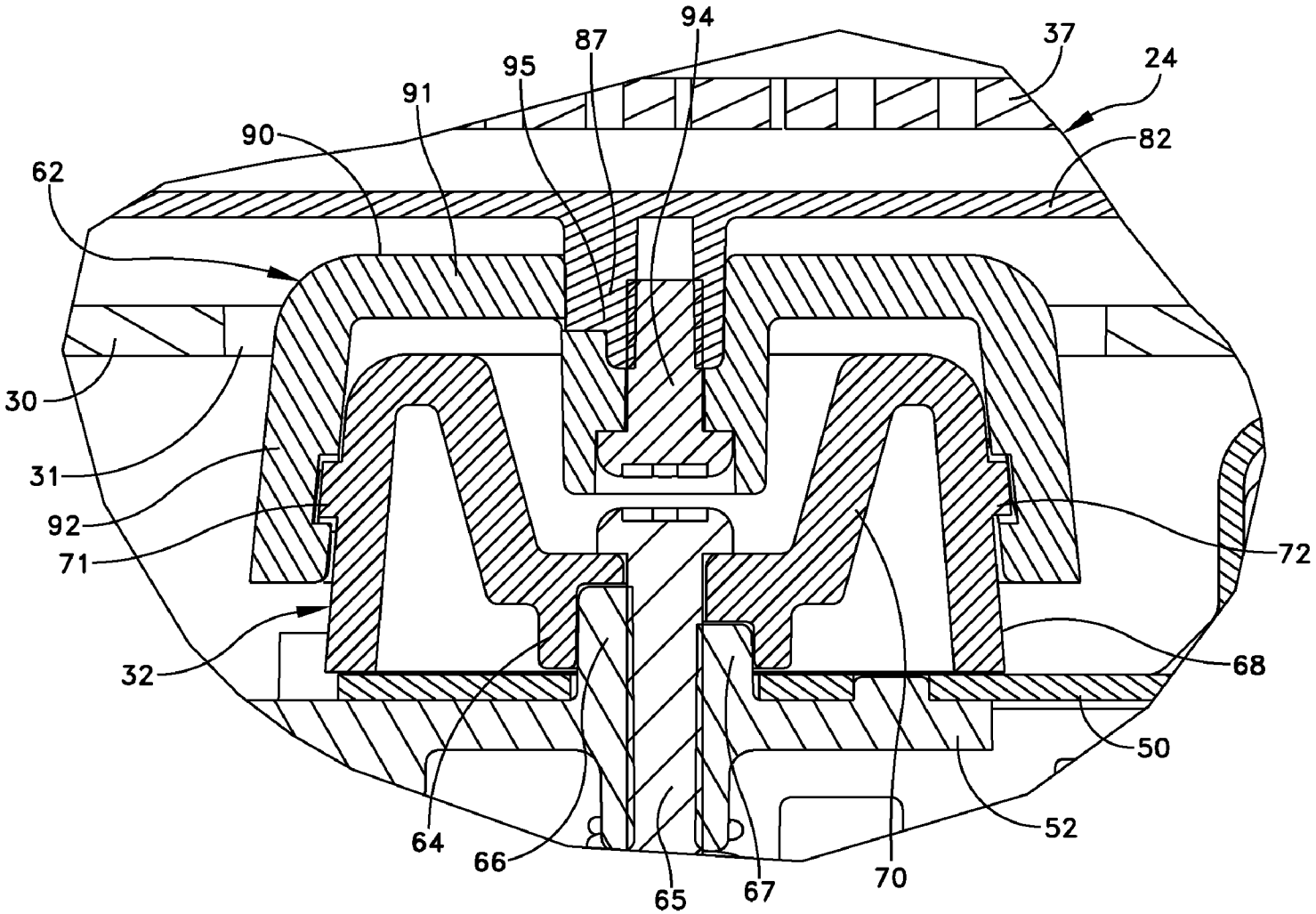
FIG. 6 is an enlarged detail of first and second attachment elements.

Referring now to FIGS. 3 and 6, vibration produced by the vibratory motion generator 36 is conveyed to the tanks 24 and 26 through the first attachment elements 32 and 35 and complementary second attachment elements 62 and 63 attached to the bottom of tanks 24 and 26 respectively. Each of these structures have essentially the same construction, so FIG. 6 depicts only the second attachment element 62 associated with the tank 24.

As shown in FIG. 6, the first attachment element 32 has a generally M-shape in cross-section and a central hub 64. The central hub 64 extends through an aperture in the plate 50. A pin 65 affixes to a shank 66 on the plate 52 thereby to clamp the structures together. Various keying components are also included, as would be apparent to those skilled in the art, to prevent rotation of the elements relative to each other. Structures at 67 represent one keying structure that prevents rotation of the first attachment element 32 relative to the support plate 52. This keying structure 66 also assures proper angular alignment of the first support structure 32 relative to the base unit 21.

Still referring to FIG. 6, the first support structure 32 has a frusto-conical portion 68 carried by an interconnecting web 70 from the central hub 64. As a result, the surface of the frusto-conical portion 68 forms a surface that tapers outwardly from the upper to the lower edges. The frusto-conical portion 68 also carries bayonet tabs 71 and 72.

Figure 7A:
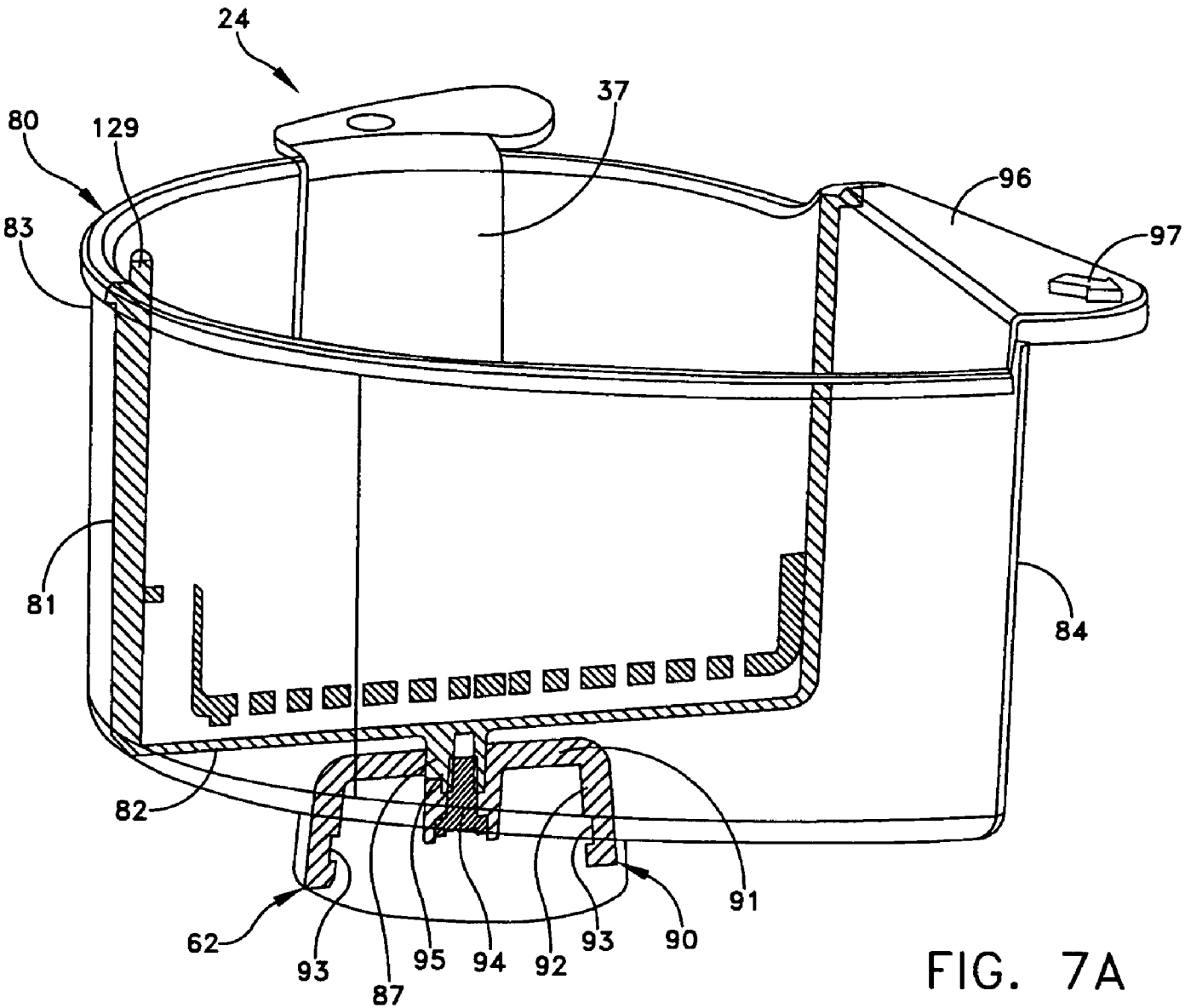
FIGS. 7A and 7B are two views of a tank constructed in accordance with this invention.
Figure 7B:
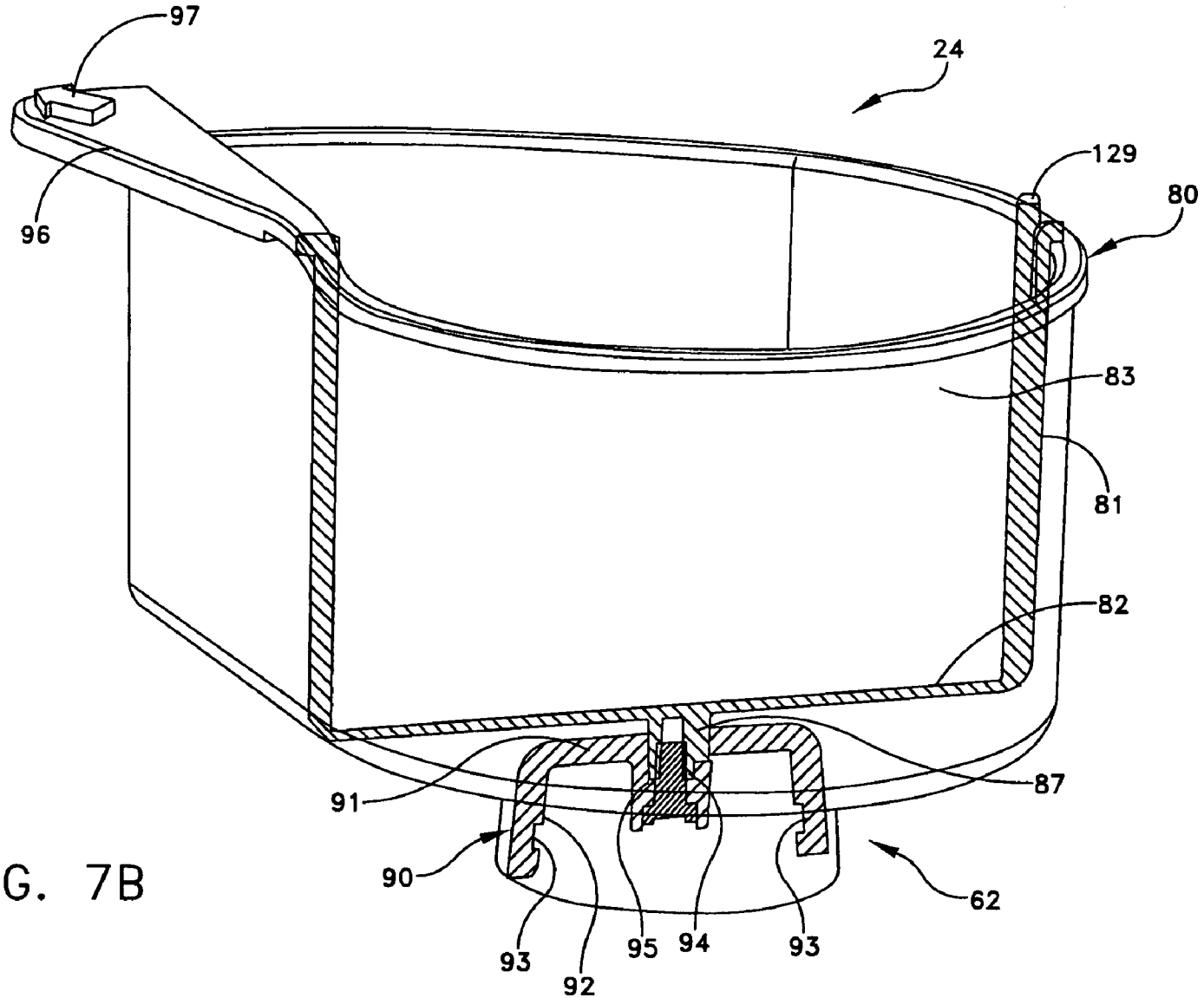

Referring to FIGS. 3 and 6, the first support structure 32 has a frusto-conical portion 68 carried by an interconnecting web 70 from the central hub 64. As a result, the surface of the frusto-conical portion 68 forms a surface that tapers outwardly from the upper to the lower edges. The frusto-conical portion 68 also carries bayonet tabs 71 and 72. oscillatory motion transfers through the first attachment elements 32 and 35 and the complementary second attachment elements 62 and 63 affixed to the bottom of each of the tanks 24 and 26, respectively. Referring specifically to FIGS. 6, 7A and 7B, each of tanks 24 and 26 has an identical structure so FIGS. 7A and 7B depict only the tank 24 that forms an open top container 80. As shown in FIGS. 7A and 7B, a rigid side wall 81 defines the periphery of the tank 24 and a bottom 82 closes the side wall 81 to form the tank 24. In this embodiment, the tank 24 has a tear drop configuration in a horizontal cross-section formed by a rounded portion 83 of the side wall 81 that meets at an apex 84.

In one embodiment, the bottom has a thickness of about 1 mm. With this thickness, the bottom 82 is compliant and attaches to the second attachment element 62 by means of a central hub 87. The central hub has a dimension that assures structural integrity during use without affecting compliance. A cup-shaped connector 90 has a base 91 and an outwardly tapering frusto-conical side wall 92. As specifically shown, the tapers of the frusto-conical portion 68 and frusto-conical portion 91 are complementary thereby to produce a rigid connection or coupling when properly seated. L-shaped slots 93 in the depending conical wall 92 are positioned to receive the bayonet tabs 71 and 72. Such bayonet structures are known and are not shown or described in any further detail.

A screw 94 or like fastener attaches the second attachment element 62 to the hub 87 and complementary keying elements at 95 prevent rotation of the second attachment element 62 with respect to the bottom 82.

Referring now to FIGS. 7A and 7B, a tab 96 extends perpendicularly from the peripheral wall 83 of the tank 24 to facilitate insertion. This tab 96 includes indicia 97 that coact with indicia 98 as shown in FIGS. 1 and 2 to provide a visual indication of locked and unlocked positions. When the tank 24 is inserted into the chamber 25 of FIGS. 1 and 2 with the indicia 97 aligned with the unlocked index 98, the bayonet entrance slots 93 on the second attachment element 62 align with the tabs 71 and 72 on the first attachment element 32. When the tank 24 is seated, rotation to position the indicia 97 at the locked index 98 fully seats the tabs 71 and 72 in their respective slots 93. As a result the vibratory motion generator 36 and tanks 24 form a rigid structure, so any motion applied to the bottom 82 agitates any liquid in the tank 24. Tank 26 has a similar structure and operation.

In use an operator opens the lid 22 to the position shown in FIGS. 1 and 2 and rotates the tank 24 so the indicia 97 aligned with the unlocked index of the indicia 98. The tank 24 is lifted vertically out of the base unit 21 and moved to a position to be filled. The tank is lowered into the chamber 25 with the indicia 97 aligned with the unlocked index. The tab 96 is used to rotate the tank 24 to align the indicia 97 with the locked index of the indicia 98 to effect the rigid connection. Next the basket 37 is lowered into the tank 24. The switch 38 is activated to energize the vibratory motion generator 36 and agitate the liquid in the tank 24 to clean the articles. Upon completion of the cleaning operation, the basket 37 can be transferred to the tank 26 for rinsing.

As will now be apparent, this structure provides several advantages. First, the tanks 24 and 26 are removable and allow the independent exchange of solutions in those tanks without having to move the entire cleaner 20 and without having to dump all the material out of the cleaning unit 20 as occurs when the tanks are integral with a base unit. As liquids interact only with the tanks 24 and 26 and the basket 37, only those elements need be constructed with a material that is chemically inert plastic. The remainder of the base unit 21 and all the elements of the lid 22 can be formed of a less expensive plastic that provides the necessary mechanical structural integrity in appropriate applications.

As previously indicated, the switch 38 controls the energization of the coil. In a preferred embodiment shown in FIG. 8, the switch 38 has four positions, namely: an OFF position, a RINSE position, a LOW CLEAN position and a HIGH CLEAN position. An alternating current source 100 powers the cleaner 20 by energizing the coil 43. A 60 Hz, 120 v household electrical source is an example. A connector 101, in the form of a receptacle and plug, provides a connection to the device through a strain relief 102 also shown in FIG. 5. One conductor connects to the common terminal 38(C) of the switch 38. The other conductor connects to one end of the coil 43.

Figure 8:
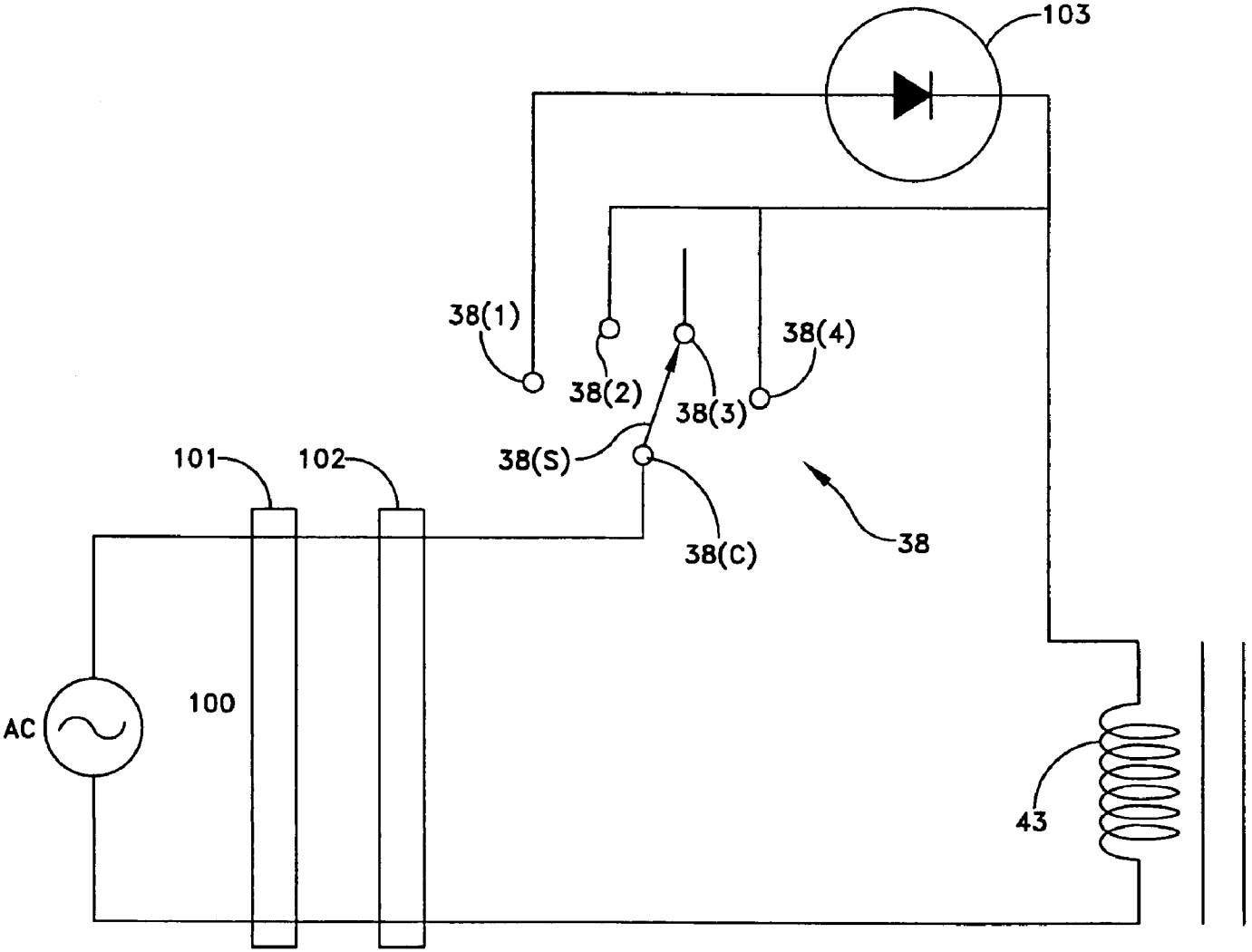
FIG. 8 is a schematic of a control circuit useful in this invention.

The switching element 38S can connect to a terminal 38(1) that can represent a LOW CLEAN position. Terminals 38(2) and 38(4) can represent HIGH CLEAN and RINSE positions, respectively. Terminal 38(3) is an OFF position. When the switching element 38S contacts position 38(3) there is no complete circuit and the coil 43 deenergizes. If the switch 38S moves to either position 38(2) or 38(4) an unrectified AC signal is applied across the coil 43 to produce a first level of agitation. Shifting the switch 38S to terminal 38(1) introduces a series diode 103 in the circuit so only half waves energize the coil 43. This provides a second level of agitation that is greater than the first level. Consequently a circuit constructed in accordance with FIG. 8 provides great flexibility in the energization of the coil 43 and the level of agitation of the materials liquid in the tanks to accommodate various types of articles.

As previously indicated, the sonic cleaner 20 includes a basket 37. FIG. 2 depicts the basket 37 with a perforated bottom 120 having a cross-section corresponding to the cross-section of a tank, such as the tank 24. A peripheral, vertical lip 121 captures any small articles in the basket 37.

The basket 37 includes a vertical extension 122 from the lip 121. Although the position of the vertical extension 122 is arbitrary, it shown in a position generally opposite the apex 84 of the tank 24. The vertical extension 122 terminates with an upper horizontal tab 123 having an aperture 124. Another tab 125 extends from another portion of the lip and has an aperture 126.

The base unit 21 has a complementary structure including a post 127 with a pin 128. The height of the post 127 is greater than the height of the lip 121.

As shown in FIG. 1, when the tank 24 is located in the chamber 25, the basket 37 is lowered until the tab 123 engages the post 127 and the pin 128 extends through the aperture 124. In this position the basket 37 is spaced above the bottom of the tank 82, as particularly shown in FIGS. 3 and 6. When the basket 37 is removed from the tank, it can be rotated to allow the tab 125 to rest on the top edge of the wall 81 with a pin 129 extending through the aperture 126. This is a drying position that is particularly useful after rinsing.

Figure 9:
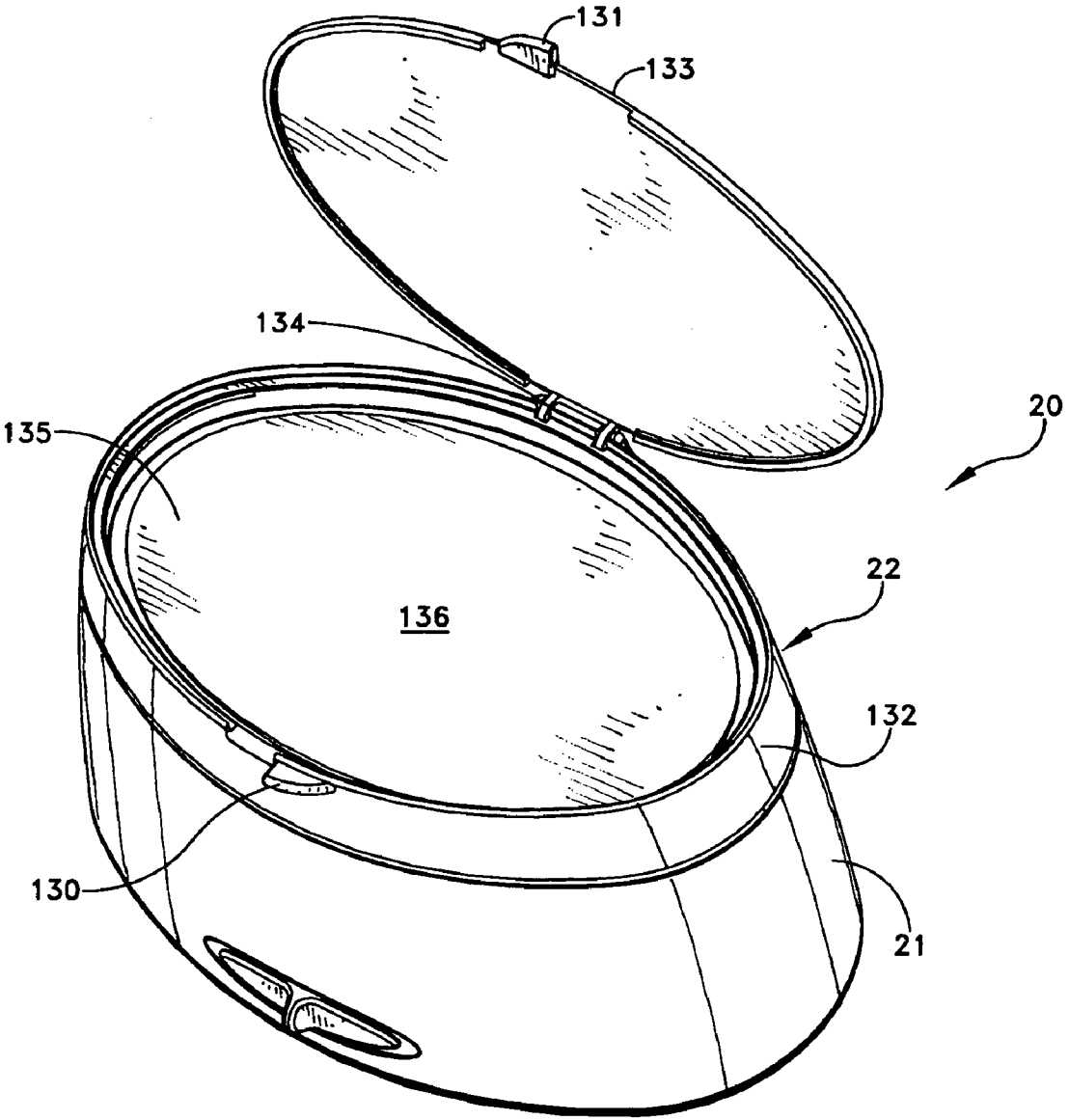
FIG. 9 is a perspective view of a cleaner depicting another aspect of this invention.

Referring now to FIGS. 3 and 9, another feature of the sonic cleaner 20 resides in its ability to store ancillary equipment. For example, small bottles of cleaning solution can be stored in the tanks 24 or 26. As shown particularly in FIG. 9, the lid 22 provides a compartment for safely storing a polishing cloth or other article. Specifically, the lid 22 includes two locking tabs 130 and 131. The tab 130 attaches at the top of a peripheral wall 132 of the lid 22. The tab 131 attaches to the edge of a top portion 133 that rotates about a hinge 134 attached to the upper edge of the lid 22 and the edge of the top 133 opposite the tab 131. A floor 135 along with the wall 132 and top 133 provides a closed storage compartment 136 for polishing cloths and the like.

As will now be apparent, a cleaner 20 that embodies the various features of this invention simplifies cleaning. Problems of liquid exchange are overcome by using tanks 24 and 26 that are connected to the vibratory motion generator 36 by releasable rigid couplings. For pouring liquids, the tear-shape of the tanks provides a natural hand hold, and the apex forms a natural spout. As the vibratory motion generator and all moving parts are isolated from the base control unit, the cleaner operates quietly and exhibits no tendency to walk on a surface. The basket 37 facilitates the handling of small articles and provides a ready means for moving the articles from a cleaning solvent to a rinse liquid and for allowing the articles to air dry.

It will now be apparent, however, that this invention can be implemented in a number of different forms. Tanks may have other cross-sections. Alternative releasable rigid couplings could be substituted for the specifically disclosed structures. Different vibratory motion generators, such as electric motors, could be substituted. However, a sonic cleaner incorporating such modifications will exhibit some or all of the benefits of this invention.

This invention has also been disclosed in a dual-tank environment. However, it will be apparent that the invention could be adapted to a single tank implementation. In a commercial implementation, certain features might be omitted such as the specifically disclosed lid structure. Different embodiments of the control system may also be implemented. Therefore, it is the intent of the appended claims to cover all such variations and modifications as come within the true spirit and scope of this invention.

What is claimed as new and desired to be secured by Letters Patent of the United States is:

1. A sonic cleaner for small articles comprising:

A) a tank for containing a liquid and articles to be cleaned,

B) a base unit that is supported on a surface, said base unit having a chamber for receiving said tank, C) a sonic vibratory motion generator attached to said base unit, D) means for mechanically isolating said vibratory motion generator and said tank from said base unit, and E) a first attachment element attached to and extending from said vibratory motion generator that produces vibratory motion that is isolated from said base unit and a second attachment element attached to and extending from said tank, said first and second attachment elements forming a releasable rigid connection therebetween whereby when seated and locked together said second attachment element and said first attachment element form a rigid connection between said tank and said vibratory motion generator whereby liquid in said tank is agitated and the vibratory motion is isolated from said base unit such that the sonic cleaner exhibits no tendency to walk on the surface and whereby when said first and second attachment elements are unlocked said tank can be removed from said base unit.

2. A sonic cleaner as recited in claim 1 wherein said first and second attachment elements include interfitting portions.

3. A sonic cleaner as recited in claim 2 wherein one of said first and second attachment elements includes a portion that nests within a portion of the other of said first and second attachment elements.

4. A sonic cleaner as recited in claim 3 wherein said portions of said first and second attachment elements include complementary tapered mating surfaces.

5. A sonic cleaner as recited in claim 4 wherein said first and second attachment elements additionally include elements that form a bayonet coupling.

6. A sonic cleaner as recited in claim 3 wherein said first and second attachment elements additionally include elements that form a bayonet coupling.

7. A sonic cleaner as recited in claim 2 wherein said vibratory motion generator includes an electric coil and an armature attached to said first attachment-element.

8. A sonic cleaner as recited in claim 2 wherein said second attachment element is formed integrally with said tank and said vibratory motion generator includes an electric coil and an armature, said first attachment element being formed integrally with said armature.

9. A sonic cleaner as recited in claim 8 wherein said vibratory motion generator includes means for connecting said electric coil to an alternating current source.

10. A sonic cleaner as recited in claim 2 wherein said tank comprises an open-top container with a peripheral side wall and a bottom, said bottom being compliant and attached to said second attachment element thereby to transfer energy from said vibratory generator means to liquid in said tank.

11. A sonic cleaner as recited in claim 2 wherein the liquid is a cleaning solvent and said tank and base unit are formed of injected plastic, the plastic material in said tank being inert to the cleaning solvent and the plastic material in said base unit being selected independently of interaction with the cleaning solvent.

12. A sonic cleaner as recited in claim 1 wherein said second attachment element is formed integrally with said tank and said vibratory motion generator includes an electric coil and an armature, said first attachment element being formed integrally with said armature.

13. A sonic cleaner as recited in claim 12 wherein said isolating means includes spring means connected to said base unit for mechanically isolating said vibratory motion generator and said tank therefrom.

14. A sonic cleaner as recited in claim 13 wherein said vibratory motion generator includes means for connecting said electric coil to an alternating current source.

15. A sonic cleaner for small articles comprising:

A) first and second tanks for receiving a liquid and articles to be cleaned,

B) a base unit that is supported on a surface and that receives said first and second tanks in first and second chambers, respectively, C) a sonic vibratory motion generator attached to said base unit, D) spring means connected to said vibratory motion generator and said base unit for mechanically isolating said vibratory motion generator and said tanks from said base unit, E) first attachment elements attached to and extending from said vibratory motion generator that produces vibratory motion that is isolated from said base unit, one of said first attachment elements being positioned with respect to said first chamber and another of said first attachment elements being positioned with respect to said second chamber, E) a second attachment element attached to and extending from each of said tanks, corresponding ones of said first and second attachment elements forming a releasable rigid connection therebetween whereby when seated and locked together said second attachment element and said first attachment element form a rigid connection between said tank and said vibratory motion generator whereby liquid in said corresponding tank is agitated and said sonic cleaner exhibits no tendency to walk on the surface and when unlocked said corresponding tank can be removed from said base unit.

16. A sonic cleaner as recited in claim 15 wherein said first and second attachment elements associated with each tank include interfitting portions.

17. A sonic cleaner as recited in claim 16 wherein one of said first and second attachment elements associated with each tank includes a portion that nests within a portion of the other of said first and second attachment elements.

18. A sonic cleaner as recited in claim 17 wherein said nested portions of said first and second attachment elements include complementary tapered mating surfaces.

19. A sonic cleaner as recited in claim 18 wherein said first and second attachment elements additional include elements that form a bayonet coupling.

20. A sonic cleaner as recited in claim 17 wherein said first and second attachment elements additionally include elements that form a bayonet coupling.

21. A sonic cleaner as recited in claim 16 wherein said second attachment element is formed integrally with said tank and said vibratory motion generator includes an electric coil and an armature, said first attachment element being formed integrally with said armature.

22. A sonic cleaner as recited in claim 21 wherein said vibratory motion generator includes means for connecting said electric coil to an alternating current source.

23. A sonic cleaner as recited in claim 16 wherein each said tank comprises an open-top container with a peripheral side wall and a bottom, said bottom being compliant and attached to said second attachment element thereby to transfer energy from said vibratory generator means to liquid in said tank.

24. A sonic cleaner as recited in claim 16 wherein one of said tanks is adapted to receive a cleaning solvent and said tank and base unit are formed of injected plastic, the plastic material in said tank being inert to the cleaning solvent and the plastic material in said base unit being selected independently of interaction with the cleaning solvent.

25. A sonic cleaner as recited in claim 15 wherein said second attachment element is formed integrally with said tank and said vibratory motion generator includes an electric coil and an armature, said first attachment element being formed integrally with said armature.

* * * * *